US006716114B2

(12) United States Patent
Nishio

(10) Patent No.: US 6,716,114 B2
(45) Date of Patent: Apr. 6, 2004

(54) WOOD-TYPE GOLF CLUB HEAD

(75) Inventor: Masayoshi Nishio, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 10/132,181

(22) Filed: Apr. 26, 2002

(65) Prior Publication Data

US 2002/0183137 A1 Dec. 5, 2002

(51) Int. Cl.[7] ..... A63B 53/02; A63B 53/04
(52) U.S. Cl. ..... 473/314; 473/345; 473/349
(58) Field of Search ..... 473/324, 345, 473/346, 349, 314, 350, 290, 291, 292

(56) References Cited

U.S. PATENT DOCUMENTS 5,306,008 A * 4/1994 Kinoshita
5,573,467 A * 11/1996 Chou
5,839,975 A * 11/1998 Lundberg
5,935,020 A * 8/1999 Stites
6,074,310 A * 6/2000 Ota
6,340,337 B2 * 1/2002 Hasebe

FOREIGN PATENT DOCUMENTS

| | | |
|---|---|---|
| JP | 6-98954 | 4/1994 |
| JP | 11-104276 | 4/1999 |
| JP | 2000-288131 | 10/2000 |

* cited by examiner

*Primary Examiner*—Sebastiano Passaniti
(74) *Attorney, Agent, or Firm*—Birch, Stewart, Kolasch & Birch, LLP

(57) ABSTRACT

A wood-type golf club head having a head volume of not less than 300 cc comprises a head main body having a club face for striking a golf ball and a hosel defining a shaft center line (CL) corresponding to the center line of a club shaft, wherein the center of gravity (G) of the club head is disposed at a distance (L) of from 26 to 36 mm from said shaft center line (CL), a sweet spot (s) on the club face is disposed at a distance of not more than 3 mm from a club face center (c) of the club face, the club face has a toe-side end (Fe) disposed at a distance (B) of from 13 to 30 mm in the toe-heel direction towards the heel from a toe-side end (Te) of the club head, and a heel end (He) of the club head is disposed at a distance (A) of from 10 to 16 mm from the shaft center line (CL).

3 Claims, 5 Drawing Sheets

Fig.2 X-Y plane

WOOD-TYPE GOLF CLUB HEAD

BACKGROUND OF THE INVENTION

The present invention relates to a wood-type golf club head, more particularly to a specific arrangement of the club face, sweet spot, center of gravity, the club shaft center and the like which is suitable for a club head having a relatively large volume of not less than 300 cc.

In recent years, there is a growing tendency for wood-type golf clubs to increase the club head volume as the manufacturing technology is progressing and makes it possible to manufacture a thin shell structure of high-strength, low specific gravity metallic materials such as titanium, titanium alloy and aluminum alloy. For instance, golf club heads for driver having a head volume over 300 cc are now produced.

When the head volume is increased, as shown in FIG. 5, the distance (L) of the center of gravity (G) of the club head (b) from the center line (cl) of the club shaft (a) increases. As a result, there is the following tendency. As shown in FIG. 6, when a golf ball (B) is struck with the club head (b), the club face (c) is inclined backward. Then, the golf ball (B) comes apart from the club face (c) although the club face (c) is not yet returned from such inclined state to the addressing state which is usually perpendicular to the aimed line, which therefore results in a slice.

In order to solve this problem, it has been proposed to provide a club face (c) with a relatively large, positive face angle (alpha) as shown in FIG. 4 and to shift the center of gravity (G) of a club head (b) towards the shaft center line (cl) as shown in FIG. 7.

In the former method, however, it is slightly difficult for average golfers to address the club head because of the relatively large face angle.

In the later method, although average golfers have a tendency to strike a golf ball in the club face center (c), the sweet spot (s) shifts towards the heel from the club face center (c), which maybe result in a hook.

SUMMARY OF THE INVENTION

It is therefore, an object of the present invention to provide a wood-type golf club head in which although the head volume is large, a slice shot as well as a hook shot can be prevented, and it is easier for average golfers to address the club and to make a good shot.

According to the present invention, a wood-type golf club head has a head volume of not less than 300 cc and comprises

- a head main body having a club face for striking a golf ball,
- a hosel defining a shaft center line (CL) corresponding to the center line of a club shaft,
- the center of gravity (G) of the club head disposed at a distance (L) of from 26 to 36 mm from said shaft center line (CL),
- a sweet spot (s) on the club face disposed at a distance of not more than 3 mm from a club face center (c) of the club face,
- a toe-side end (Fe) of the club face disposed at a distance (B) of from 13 to 30 mm in the toe-heel direction towards the heel from a toe-side end (Te) of the club head, and
- a heel end (He) of the club head provided at a distance (A) of from 10 to 16 mm from the shaft center line (CL).

DESCRIPTION OF THE PREFERRED EMBODIMENTS

The present invention will now be described in detail in conjunction with the accompanying drawings.

According to the present invention, club head 1 comprises a head main body 1*a* and a hosel 1*b* adapted for suitable attachment to the end of a golf club shaft.

The head main body 1*a* comprises a face portion 3 having a club face 2 for striking a golf ball for which a specific loft angle (gamma) is provided.

The hosel 1*b* is provided with a shaft hole 9 into which the end of the golf club shaft is inserted for attachment.

DEFINITIONS

Firstly, the following terms used in this invention are defined.

Sweet spot (S): A point on the club face 2 at which a straight line (N) which is drawn perpendicularly to the club face 2 from the center of gravity (G) of the club head, intersects the club face 2.

Measuring state: A state of the club head such that the club head is set on a horizontal plane HP with its lie angle (beta) and loft angle (gamma).

X-Y-Z coordinates: Rectangular coordinates, whose origin is set at the club head's center of gravity (G), and which has Z-axis perpendicular to the horizontal plane HP,
X-Y plane parallel with the horizontal plane HP,
Y-Z plane including the straight line N, and
X-Z plane.

Toe-heel direction: The X axis direction of the X-Y-Z coordinates. Thus, it is parallel to the horizontal plane when the club head is in the measuring state.

Up-down direction: The Z axis direction of the X-Y-Z coordinates.

Front-back direction: The Y axis direction of the X-Y-Z coordinates.

Figure 1:
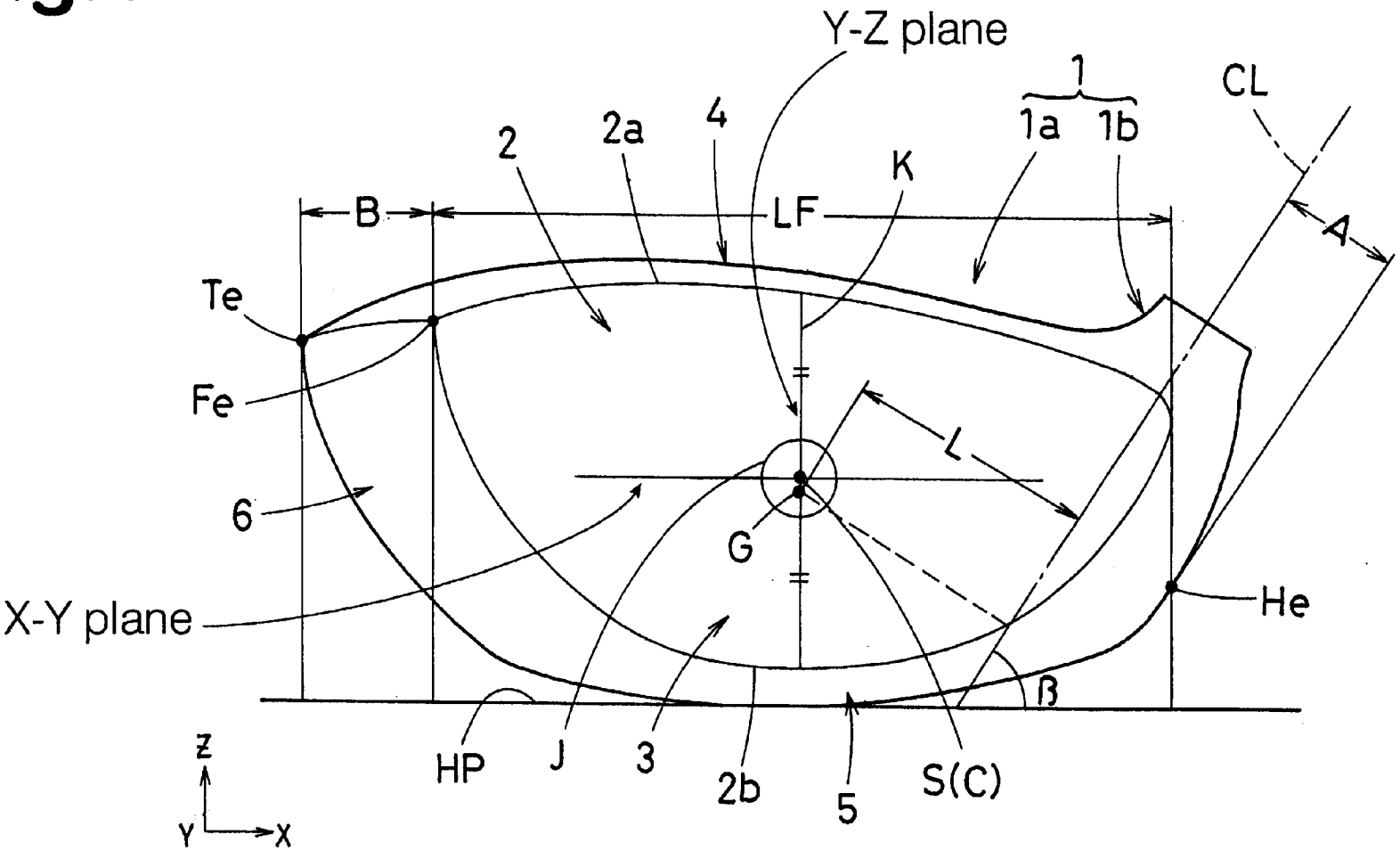
FIG. 1 is a front view (X-Z projection) of a wood-type golf club head according to the present invention.

X-Z projection: A projection of the club head 1 on a plane parallel with the X-Z plane (FIG. 1).

Figure 2:
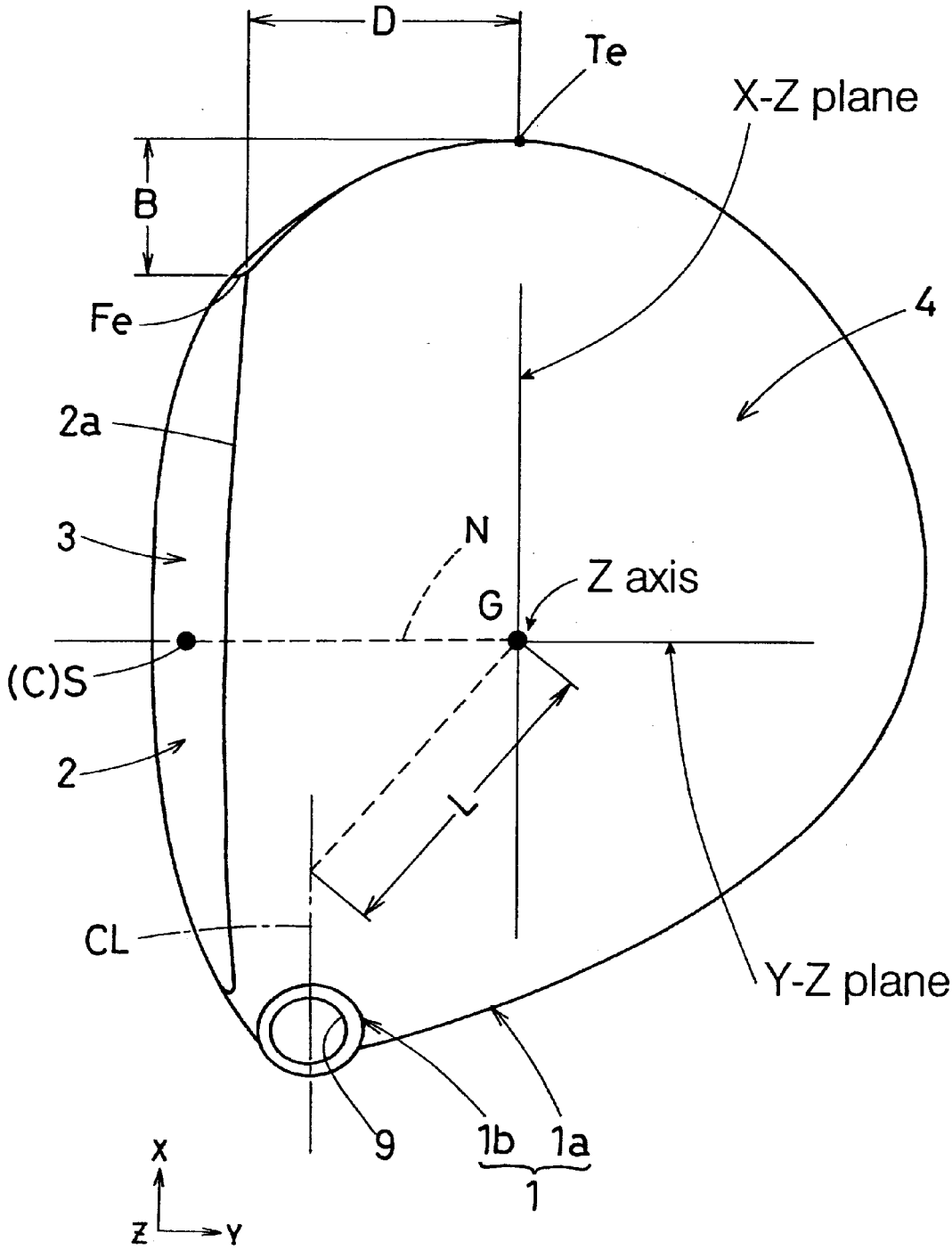
FIG. 2 is a top view (X-Y projection) of the golf club head.

X-Y projection: A projection of the club head 1 on a plane parallel with the X-Y plane (FIG. 2).

Shaft center line CL: The center line or the axis of the golf club shaft to which the club head is attached. In case of a club head having a shaft hole 9, the shaft center line CL is defined by the center line of the shaft hole 9.

Club face toe-side end Fe: The extreme end of the club face 2 on the toe side thereof in the toe-heel direction.

Club face heel-side end: The extreme end of the club face 2 on the heel side thereof in the toe-heel direction.

Club head toe-side end Te: The extreme end of the club head 1 on the toe side thereof in the toe-heel direction.

Club head heel-side end He: The extreme end of the club head 1 on the heel side thereof in a specific direction which is perpendicular to the shaft center line CL in the X-Z projection.

Club face center C: A point on the club face 2 corresponding to the midpoint of a straight line K which is drawn in the up-down direction in the X-Z projection so as to extend from the upper edge 2*a* to the lower edge 2B of the club face 2 while dividing the length LF in the toe-heel direction between the club face toe-side end Fe and the club face heel-side end into two halves.

EMBODIMENT

Figure 3:
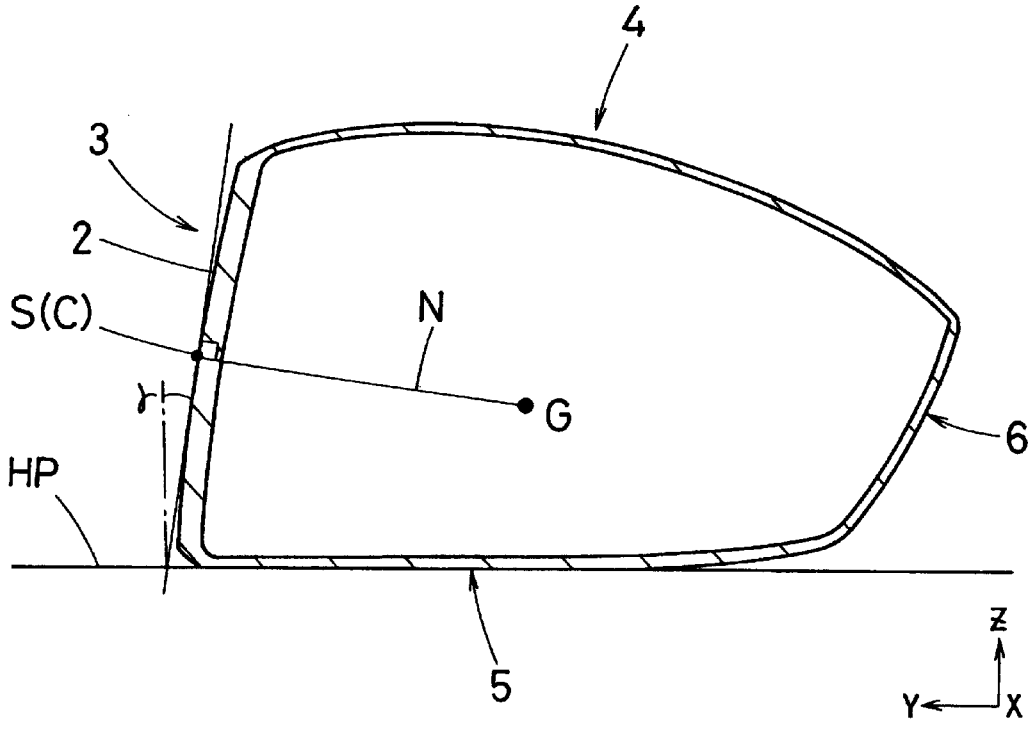
FIG. 3 is a cross sectional view of the golf club head taken along the X-Z plane.

In FIGS. 1 to 3 which show an embodiment of the present invention, the club head 1 is for a driver, but the club head can be formed for another numbered wood.

The present invention is suitably applied to a wood-type club head having a head volume not less than 300 cc. Thus, the club head 1 has a head volume of not less than 300 cc, but preferably not more than 450 cc, more preferably not more than 430 cc. Incidentally, the head volume is the apparent volume of the head main body 1*a* inclusive of the hosel 1*b*.

In the figures, shown is the club head 1 in the above-mentioned measuring state.

The head main body 1*a* has a shell structure which comprises a crown portion 4 defining a top face of the head, a sole portion 5 defining a sole of the head and a wall portion 6 extending between the crown portion 4 and sole portion 5 which portions 4, 5 and 6 are formed by monolithic molding, and a face portion 3 attached to this monolithic body so as to close the front opening thereof defining the above-mentioned club face 2. Also the above-mentioned hosel 1*b* is formed integrally with the monolithic body by the monolithic molding.

In this example, the hosel 1*b* is positioned at a point of intersection of the face portion 3, crown portion 4 and side wall portion 5 on the heel-side, and it protrudes upwards in a short length presenting a pipe-like shape.

Such club head 1 can be made of a metallic material and/or fiber reinforced resin. For the metallic material, stainless, titanium, titanium alloy, aluminum alloy and the like can be used alone or in combination.

According to the invention, the extent of the club head 1 towards the heel is limited such that, as shown in FIG. 1, the distance (A) of the club head heel-side end He from the shaft center line CL is in a range of from 10 to 16 mm, preferably 10 to 15 mm, more preferably 10 to 14 mm when measured in the direction perpendicular to the shaft center line CL in the X-Z projection.

Next, the position of the center of gravity (G) of the club head 1 is determined such that the center of gravity (G) is at a distance (L) in a range of from 26 to 36 mm, preferably 26 to 34 mm, more preferably 28 to 33 mm from the shaft center line CL, and the sweet spot (s) whose position depends on the center of gravity (G) is positioned substantially at the club face center (C) or within a circle (J) of 3 mm radius described on the club face 2 centering at the club face center (c).

Further, the extent of the club face 2 towards the toe is limited such that, as shown in FIG. 1, the club face toe-side end Fe is positioned on the heel side of the club head toe-side end Te, and the distance (B) between the club face toe-side end Fe and the club head toe-side end Te is in a range of from 13 to 30 mm, preferably 14 to 28 mm, more preferably 18 to 25 mm when measured in the toe-heel direction.

The club face 2 is defined by a plane which is flat or slightly curved with a very large radius when compared with the distance between the center of gravity (G) and the club face 2, namely, the club face is substantially flat.

As shown in FIG. 1, in the front view of the club head 1 or in the X-Z projection, the club face 2 is completely embraced by the contour of the club head 1. And the above-mentioned length LF of the club face 2 in the toe-heel direction is set in a range of from 80 to 105 mm, preferably 85 to 100 mm.

On the other hand, as shown in FIG. 2, in the top view of the club head 1 or in the X-Y projection, the distance D between the club head toe-side end Te and club face toe-side end Fe in the Y axis direction is set in a range of from 20 to 40 mm, preferably 25 to 35 mm.

Figure 4:
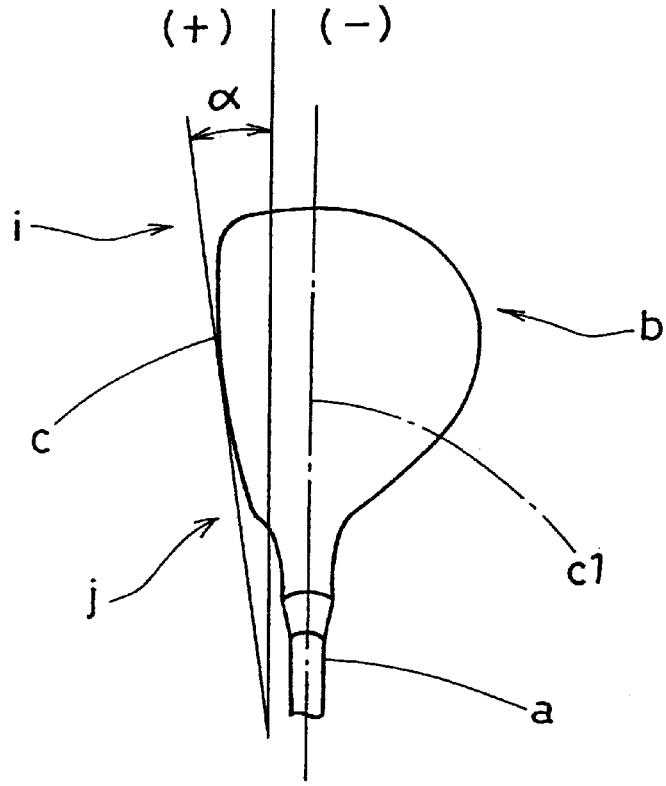
FIG. 4 is a top view of a wood-type club head for explaining a face angle and a problem involved in a club head having a large face angle.
Figure 5:
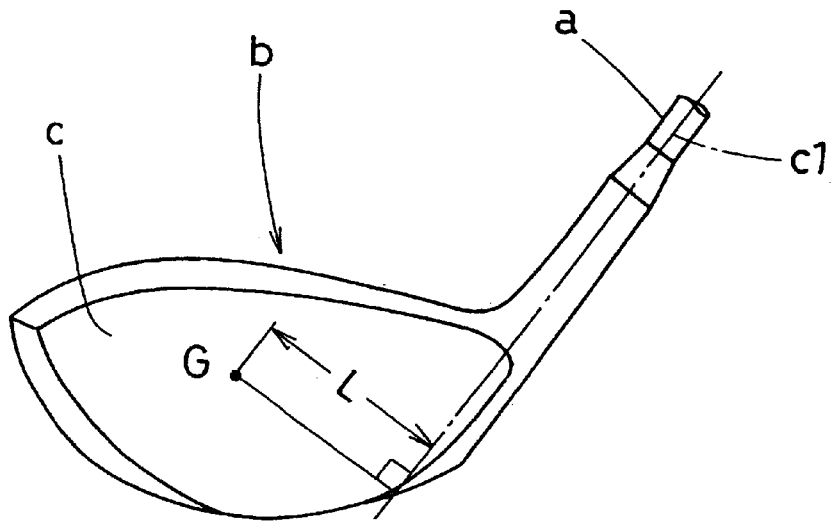
FIG. 5 is a partial front view of a driver for explaining the distance of the center of gravity of the club head from the center of the club shaft.
Figure 6:
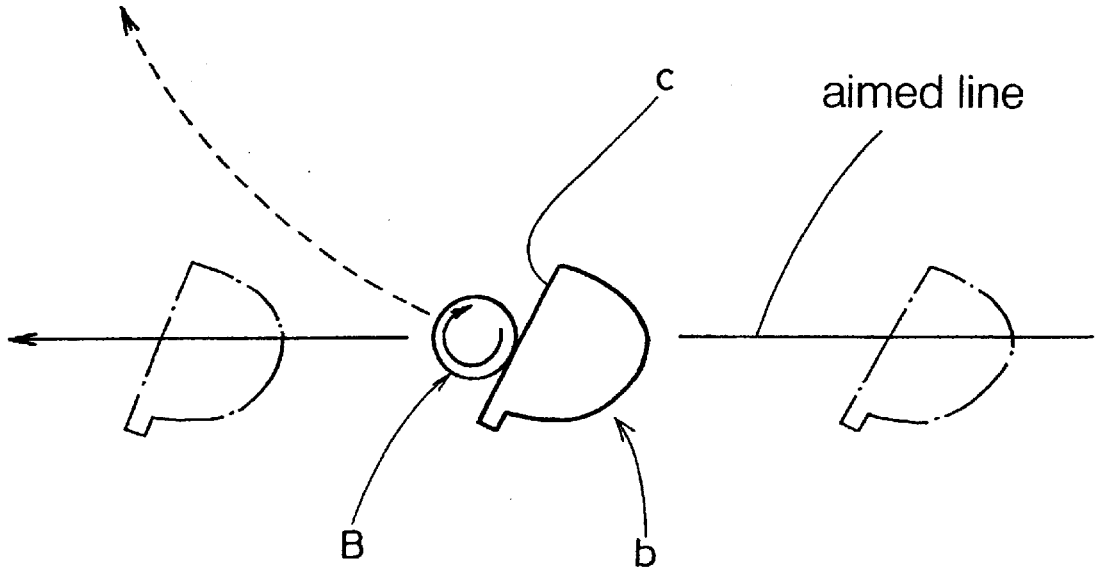
FIG. 6 is a diagram for explaining a potential problem involved in a driver or numbered wood-type clubs having a large head volume.
Figure 7:
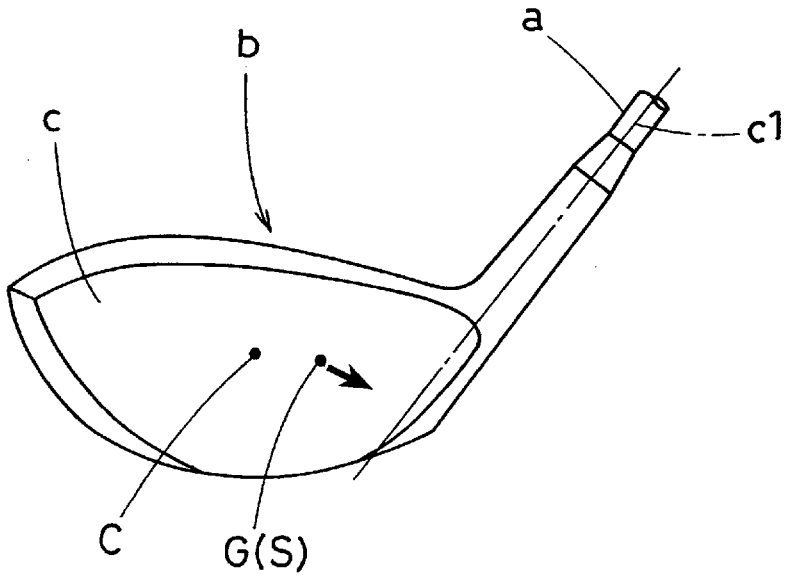
FIG. 7 is a partial front view of a driver for explaining a shift of the center of gravity towards the heel and a problem involved therein.

Furthermore, the club face is provided with a very small face angle (alpha) which is preferably in a range of from +2 to +6 degrees, more preferably +2 to +4 degrees with respect to the toe-heel direction, wherein the plus (+) sign means the counterclockwise direction as shown in FIG. 4.

If the distance (L) of the center of gravity (G) is less than 26 mm, there is a tendency for the shot to become a hook. If the distance (L) exceeds 36 mm, there is a tendency for the shot to become a slice. Further, it becomes difficult to set the sweet spot in the club face center (c).

If the distance (A) is less than 10 mm or more than 16 mm, it becomes difficult to set the sweet spot in the club face center (C).

If the distance (B) is less than 13 mm, it again becomes difficult to set the sweet spot in the club face center (c). If the distance (B) is more than 30 mm, it becomes difficult to address.

If the length (LF) is less than 80 mm, there is a tendency to put a mental pressure on the golfer such that the club face is small and make it difficult to strike a ball at the sweet spot. If the length Lf is more than 105 mm, it is difficult to set the sweet spot in the club face center (c).

If the distance (D) is less than 20 mm, there is a tendency for the golfer to misrecognize the club face center or sweet spot. If the distance D is more than 40 mm, the shape of the club head probably becomes unordinary which maybe make it difficult to address.

Comparison Tests

Based on the basic structure shown in FIGS. 1, 2 and 3, club heads (loft angle=11 degrees, lie angle=56 degrees, head volume=310 cc) were made according to the specifications shown in Table 1, and using those club heads, golf clubs (driver of 46 inch length) were made and tested for directional tendency of hit golf balls and restitution coefficient.

In the tests, golf balls were struck with the test golf clubs by ten golfers ranging in handicap from 5 to 25. When the hit golf ball fell within 5 yards in the right-left direction from a given target point, the club was judged to have no directional tendency, and indicated in Table 1 as "neutral". When the hit golf ball fell over 5 yards from the target point towards the right or left direction, the club was judged to have a directional tendency, and indicated in Table 1 as "right" or "left" accordingly.

Further, the restitution coefficient (=ball speed/head speed) was measured and the average is shown in Table 1.

TABLE 1

| Club head | Ex. 1 | Ref. | Ref. | Ref. | Ex. 2 | Ex. 3 | Ref. 4 | Ex. 4 | Ex. 5 | Ex. 6 | Ref. 5 |
|---|---|---|---|---|---|---|---|---|---|---|---|
| L (mm) | 32.0 | 39.0 | 25.0 | 32.0 | 27.0 | 35.0 | 37 | 35.5 | 27.0 | 29.0 | 25.5 |
| A (mm) | 14 | 9 | 9 | 17 | 14 | 14 | 14 | 14 | 14 | 14 | 14 |
| B (mm) | 18 | 11 | 34 | 9 | 25 | 14 | 12 | 13 | 28 | 30 | 32 |
| LF (mm) | 95 | 113 | 100 | 100 | 88 | 99 | 110 | 102 | 85 | 83 | 81 |
| Sweet spot | | | | | | | | | | | |
| Distance *1 (mm) | 0 | 4 | 4 | 4 | 2 | 1 | 4 | 3 | 1 | 3 | 4 |
| Direction *2 | — | toe | heel | heel | heel | toe | toe | toe | heel | heel | heel |
| Test results | | | | | | | | | | | |
| Directional tendency | | | | | | | | | | | |
| Neutral (person) | 8 | 1 | 3 | 4 | 6 | 8 | 2 | 5 | 7 | 5 | 3 |
| Right (person) | 0 | 9 | 0 | 1 | 0 | 2 | 8 | 4 | 0 | 1 | 0 |
| Left (person) | 2 | 0 | 7 | 5 | 4 | 0 | 0 | 1 | 3 | 4 | 7 |
| Restitution coefficient | 1.463 | 1.435 | 1.444 | 1.442 | 1.461 | 1.460 | 1.436 | 1.455 | 1.459 | 1.452 | 1.443 |

*1) The distance from the club face center C.
*2) The direction of the shift when the distance is not zero.

From the test results, it was confirmed that the club heads according to the present invention are improved in the directional controllability and restitution coefficient.

What is claimed is:

1. A wood-type golf club head having a head volume of not less than 300 cc and comprising a head main body having a club face for striking a golf ball, a hosel defining a shaft center line (CL) corresponding to the center line of a club shaft, the center of gravity (G) of the club head disposed at a perpendicular distance (L) of from 26 to 36 mm from said shaft center line (CL), a sweet spot (S) on the club face disposed at a distance of not more than 3 mm from a club face center (C) of the club face, a toe-side end (Fe) of the club face disposed at a distance (B) of from 13 to 30 mm in the toe-heel direction towards the heel from a toe-side end (Te) of the club head, a heel end (He) of the club head provided at a perpendicular distance (A) of from 10 to 16 mm from the shaft center line (CL).

2. A wood-type golf club head according to claim 1, wherein the length of the club face in the toe-heel direction is in a range of from 80 to 105 mm.

3. A wood-type golf club head according to claim 1 or 2, wherein said distance (A) is in a range of from 10 to 14 mm, and said distance (B) is in a range of from 18 to 25 mm.

* * * * *

UNITED STATES PATENT AND TRADEMARK OFFICE

CERTIFICATE OF CORRECTION

PATENT NO. : 6,716,114 B2
DATED : April 6, 2004
INVENTOR(S) : Masayoshi Nishio

It is certified that error appears in the above-identified patent and that said Letters Patent is hereby corrected as shown below:

Title page,
Please add the following Item:
-- [30] Foreign Application Priority Data,
April 27, 2001 (JP) ……..2001-132227 --

Signed and Sealed this

Seventeenth Day of August, 2004

JON W. DUDAS
*Acting Director of the United States Patent and Trademark Office*